US006392603B1

(12) United States Patent
Kurz et al.

(10) Patent No.: US 6,392,603 B1
(45) Date of Patent: May 21, 2002

(54) MODULE ANTENNA DEVICE

(75) Inventors: Hans-Peter Kurz, Regen (DE); Henrik Arwedson, Uppsala (SE); Howard Johnson, Franklin, TN (US)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/698,850

(22) Filed: Oct. 27, 2000

(30) Foreign Application Priority Data

Feb. 9, 2001 (SE) ..... 9903909

(51) Int. Cl.[7] ..... H01Q 1/24; H01Q 1/52
(52) U.S. Cl. ..... 343/702; 343/745; 343/841
(58) Field of Search ..... 343/700 MS, 702, 343/841, 745; H01Q 1/24, 1/38, 1/52

(56) References Cited

U.S. PATENT DOCUMENTS

| | | | | |
|---|---|---|---|---|
| 3,925,740 A | | 12/1975 | Steensma | 333/82 B |
| 5,408,241 A | | 4/1995 | Shattuck, Jr. et al. | 343/700 MS |
| 5,678,216 A | | 10/1997 | Matai | 343/700 MS |
| 5,874,920 A | * | 2/1999 | Araki et al. | 343/702 |
| 6,014,113 A | * | 1/2000 | Orchard et al. | 343/841 |
| 6,204,825 B1 | * | 3/2001 | Wilz | 343/841 |

FOREIGN PATENT DOCUMENTS

| | | |
|---|---|---|
| DE | 32 47 425 | 1/1987 |
| EP | 0 272 752 A2 | 6/1988 |
| EP | 0 707 355 A1 | 4/1996 |
| JP | 6260949 | 9/1994 |

* cited by examiner

*Primary Examiner*—Michael C. Wimer
(74) *Attorney, Agent, or Firm*—Burns, Doane, Swecker & Mathis, L.L.P.

(57) ABSTRACT

An RF module having an RF antenna integrated with a RF shielding part is disclosed. The arrangement includes a tuning mechanism for tuning the RF antenna according to a Voltage Standing Wave Ratio (VSWR) specification to thereby tolerate bigger tolerances of the other components on the printed circuit board. More space on the printed circuit board is also obtained as well as avoiding RF losses in transmission lines and soldering connections to an external antenna. A metallic shield can be produced from a single metallic sheet or a molded metallized piece being formed to a desired shape, thereby forming an antenna radiator member integrated with the screening portion of the metallic shield, the antenna radiator member extending over or resting against a supporting element. The VSWR of the antenna radiator member can be tuned by twisting, rotating or shifting the supporting element, which rests on a printed circuit board underlying the antenna device and carrying the electronic components of the RF module.

9 Claims, 7 Drawing Sheets

MODULE ANTENNA DEVICE

This application claims priority under 35 U.S.C. §§119 and/or 365 to 9903909-1 filed in Sweden on Oct. 29, 1999; the entire content of which is hereby incorporated by reference.

TECHNICAL FIELD

The present invention relates to antennas integrated into a RF module and more particularly to antenna integration for RF modules utilizing a shielding member.

BACKGROUND

The utilization of RF modules for transferring data and other signals is an increasing branch in modern techniques. There is a general aim of using wireless communication to terminals and auxiliary equipment to avoid having a lot of cables interconnecting the devices. A typical frequency for this may for instance be a range of the order 1 to 5 GHz. One problem within the techniques of using small RF modules is to obtain an effectively operating antenna within the very limited space offered by the small RF module itself. Prior art discloses mostly the use of an external antenna, which means that RF signals are fed from the RF module to the main printed circuit board (PCB) and therefrom to the external antenna, which may be on the PCB or mounted at another location.

One approach for solving some of the problems with an external antenna has been the utilization of ceramic antennas, but with the drawback of increased weight and difficulties in tuning the antenna during production/soldering, besides printed circuit board mounted external antennas require space on the PCB.

There are found numerous documents discussing antenna solutions within a limited space. A representative technical field for this is for instance in connection to radio pagers. For example a document U.S. Pat. No. 5,678,216 discloses a radio pager with a half-size micro-strip antenna. A pair of electrically conductive elements is surrounding a PCB onto which the pager circuitry components are mounted. The conductive elements form an electromagnetic shield case for the circuitry elements. The micro-strip antenna is then carried by one of the conductive elements.

Another document EP-A1-0 707 335 discloses an antenna device designed to increase the volume, which it occupies in a mobile communication apparatus as well as to achieve a large gain and a wide frequency band width without occupying a large area on a main printed circuit board and without changing the size of the apparatus.

A Japanese document JP6260949 discloses a solution for protecting the electronic equipment from static electricity and also preventing undesired radiation in a limited space without deteriorating the antenna gain by using an antenna which doubles as a shielding case. A multi-layer printed board includes four layers where a second layer is used as a circuit blocking ground and a third layer forming an antenna portion connected in series with a U-shaped antenna portion doubling as a shielding case. The first and fourth layers are carrying the components of the electronic circuitry.

However documents according to the state of the art disclosed so far does not present an optimum desired solution for an antenna module suitable for a RF module including a small RF sub-module. There is still a demand for a solution enabling easy antenna integration and optimum tuning of the antenna operational frequency in connection to the production/soldering of a small RF module.

SUMMARY

The present invention discloses integration of a RF antenna into a RF shielding part of a RF module and presents simultaneously a unique tuning mechanism for tuning the RF antenna according to a Voltage Standing Wave Ratio (VSWR) specification to thereby tolerate bigger tolerances of the other components on the printed circuit board. Thereby more space at the PCB is also obtained as well as avoiding RF losses in transmission lines and soldering connections to an external antenna. The risks of stop in the production process due to that an integrated antenna being out of VSWR specification then also will be eliminated.

A module antenna device according to the present invention is set forth by the independent claim 1 and further embodiments are set forth by the dependent claims 2 to 10.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
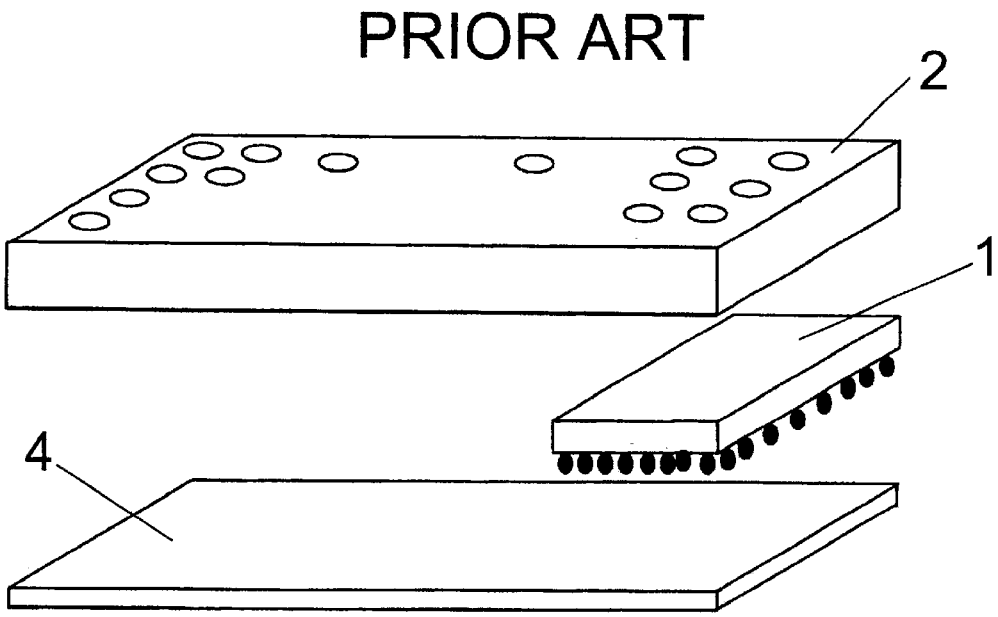
FIG. 1 illustrates a standard RF module according to the state of the art.

Most RF modules require RF shielding. Most common technology for this is stamped metal pieces, soldered over the components as illustrated by FIG. 1 according to the state of the art. Instead of a metal piece a molded plastic piece with at least one metallized surface may be used. The components may be in the form of integrated circuits or discrete components like surface mounted resistors, capacitors or transistors. The present inventive idea is to extend the shielding part with an antenna structure, preferably with both the shielding and antenna functions manufactured in one piece during a single stamping and bending production process or a molding and metallizing process.

Furthermore, physical tolerances in the production process will act on the resonance frequency as well as the bandwidth of the antenna. Especially when the physical dimensions of antennas are small compared to the wavelength, the bandwidth of an antenna is narrow and therefore it is quite sensitive for unwanted tolerance variations. If for instance a tool for the antenna production process wears out, only a time consuming exchange of the production tools can readjust the VSWR of the produced antenna. This process may stop the production lines for a considerable time, which will be considered as an essential disadvantage.

The prior art configuration according to FIG. 1 discloses a few main parts of a RF module. Reference number 1 indicates a RF sub-module containing for instance a necessary oscillator, modulator and amplifier system for a transmitting section. The RF sub-module 1 is positioned on a printed circuit board 4 also containing the rest of the necessary electronic circuitry (not shown) for the desired function of the RF module, for instance a receiver portion. The RF sub-module may in a typical embodiment for instance constitute an integrated circuit. The RF module with its sub-module 1 is shielded by a metal screening device 2, which also covers the rest of the PCB circuitry. The kind of design illustrated in FIG. 1 will then utilize some kind of external antenna for its function, located on a main PCB or outside the chassis of the device.

Figure 2:
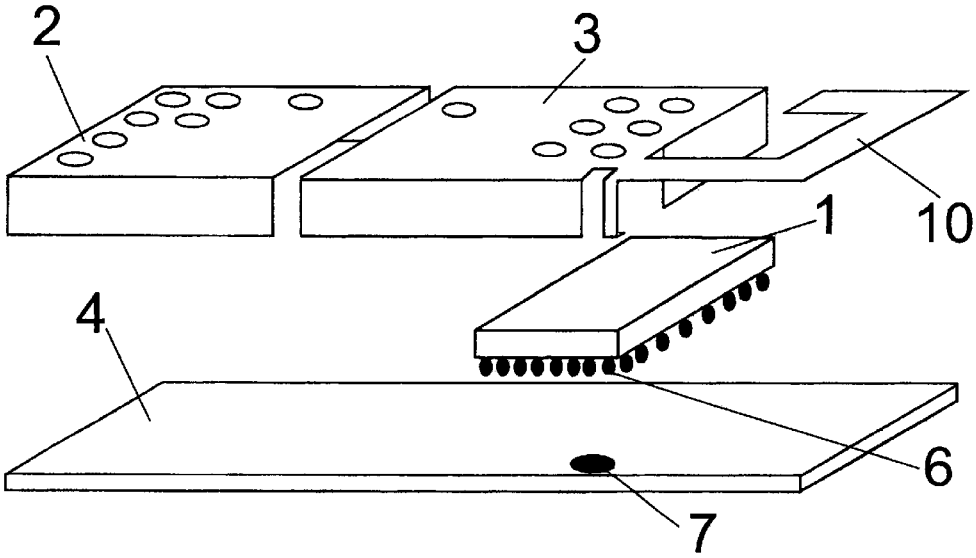
FIG. 2 illustrates an embodiment of a RF module with an antenna integrated into the shielding according to the present invention.

FIG. 2 is an illustrative embodiment of a RF module presenting an integrated antenna device 10 according to the present invention. The device of FIG. 2 resembles the device of FIG. 1 with the common parts 1, 2 and 4. The shielding includes also a second portion 3, however portions 2 and 3 may also here constitute one single element. The printed circuit board is provided with a terminal pad 7 for the connection of an antenna element 10 integrated with the shielding metallic or metallized portion 3. A terminal pad 7 at the PCB 4 is positioned close to an antenna terminal pin 6 of the RF sub-module 1.

Figure 3:
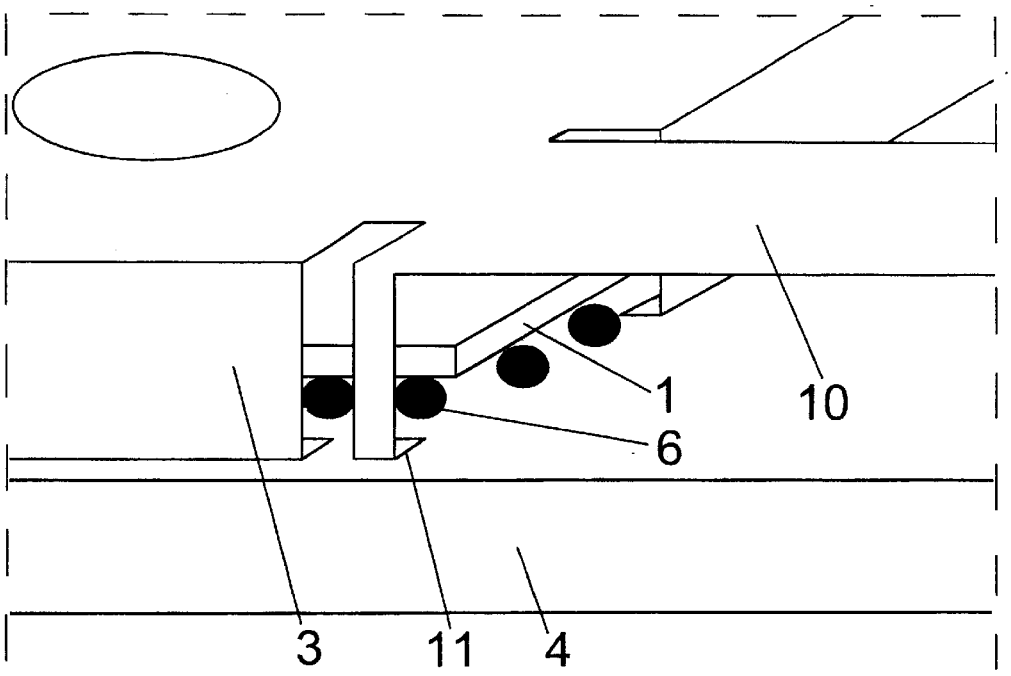
FIG. 3 is an enlarged side view of the feeding section of the antenna of the RF module according to FIG. 2.

In FIG. 3 is shown an enlarged portion of FIG. 2. The shielding portion 3 has been formed into a connecting portion 11 connecting to the antenna element 10. The antenna can be matched by designing the dimensions of the "hot" contact as well as a ground contact according to the utilized frequency. This shielding portion 3 will form a self-supporting strip-line element or a planar element 10. The strip-line element or planar element 10 is using the rest of the shielding structure 3 as a counter element. The size of this counter element will also act on the bandwidth of the antenna device arranged in this manner. This is also the reason why it in some cases may be advantageously to divide the shield into the portions 2 and 3 as illustrated.

Figure 4:
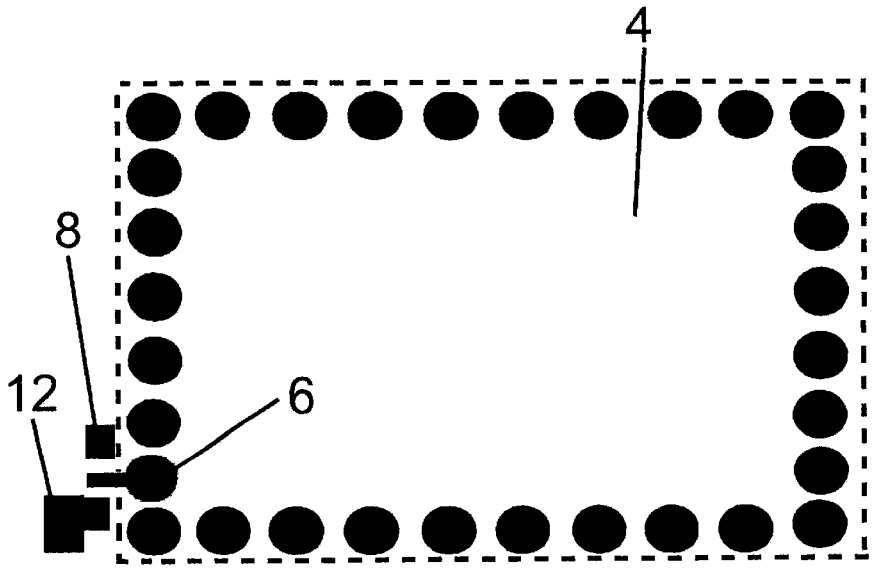
FIG. 4 illustrates a sub-module and a feeding section of the antenna in a top view.

FIG. 4 illustrates a portion of the printed circuit board 4 receiving the pinning of the illustrative RF sub-module 1. The output terminal pin at 6 is positioned close to a terminal pad 12 arranged for receiving the connecting portion 11 of the screening portion with antenna arrangement. In this embodiment the PCB 4 is also provided with another terminal pad 8 for an optional external antenna to be connected to a transmission line (not shown). In the case an external antenna is required, the pad 8 has to be connected to the antenna pad 6, e.g. by a 0 Ohm resistor (not shown).

Figure 5:
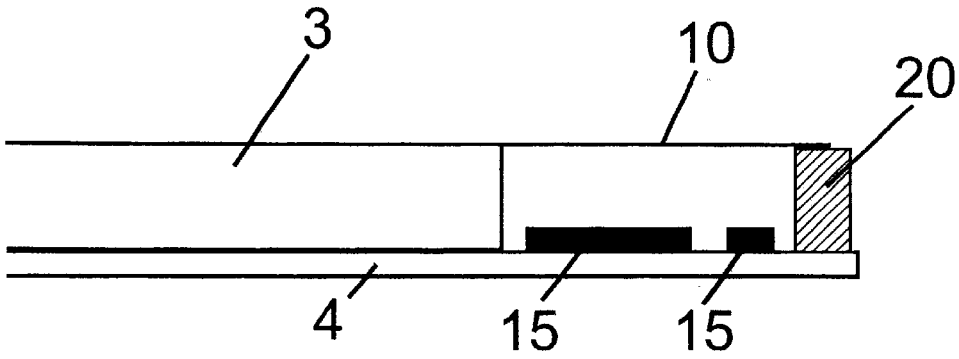
FIG. 5 illustrates a side view of the RF module according to FIG. 2 on a PCB.

In FIG. 5 is illustrated the RF module of FIG. 2 in a side view. It should be noted that the RF sub-module 1 is positioned such that the antenna element 10 preferably will be overlying the PCB 4. According to FIG. 5 an additional supporting member 20 for the antenna element 10 is added. However, the antenna element will not affect space for components 15 mounted on the PCB 4.

Figure 6:
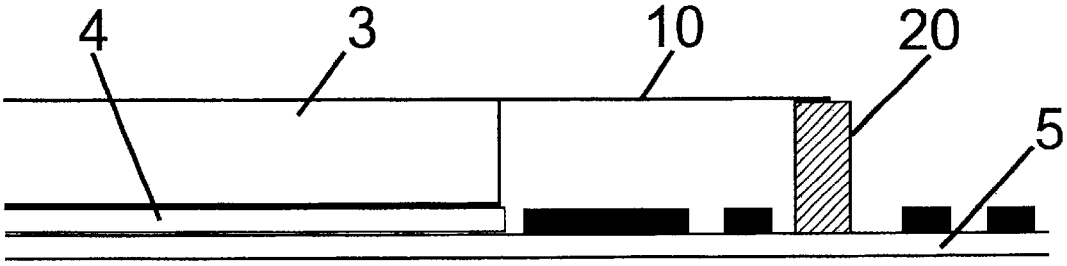
FIG. 6 illustrates an embodiment including a supporting member, which presents a tuning option for the RF module of FIG. 5.

If more antenna space is required or the height of the shielding portion 3 is very low compared to the operating wavelength, the antenna element 10 may extend over a main PCB 5 as illustrated in FIG. 6. If the problem only is the height of the antenna element 10 over the module PCB 4 the antenna element 10 may also be designed such that it will be situated somewhat higher than the shielding 3.

Figure 7:
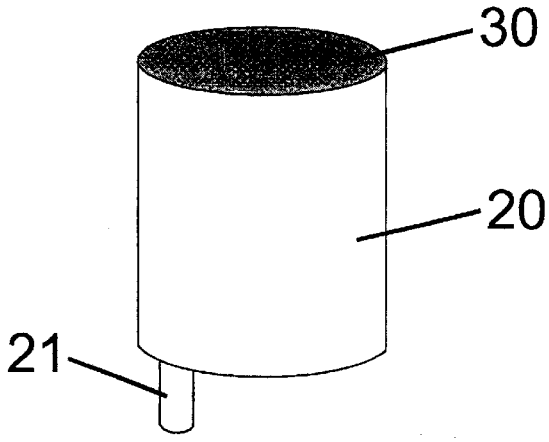
FIG. 7 illustrates a supporting member presenting an asymmetric pin with a metal plated top for a tuning arrangement according to FIG. 6.
Figure 8:
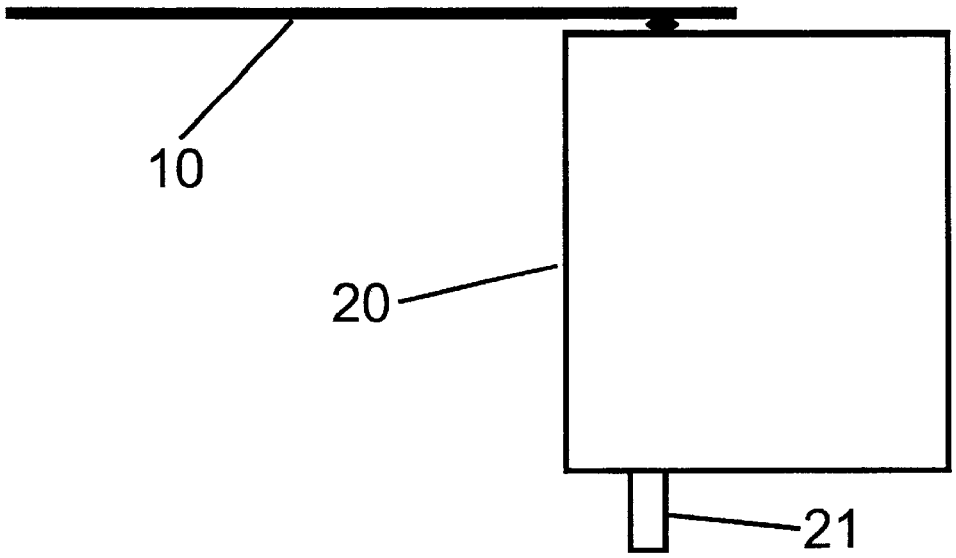
FIG. 8 illustrates in a side view the integrated antenna of FIG. 2 and the supporting member with the metal plated top according to FIG. 7.
Figure 9:
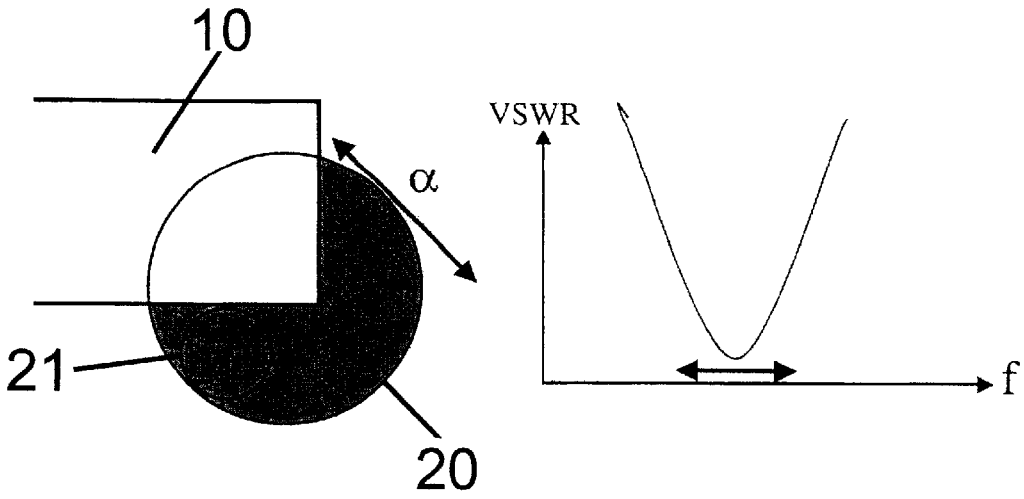
FIG. 9 shows the end of the antenna element and the supporting member seen from above illustrating the tuning facility by means of the eccentrically positioned pin.

In an embodiment demonstrated in FIG. 7 this supporting member has an eccentrically positioned pin 21 passing through a corresponding through-hole in the module PCB 4 or the main PCB 5. Furthermore the nonconducting supporting member 20 is for instance provided with a conducting surface 30 on the top. The conducting surface 30 makes contact with a portion of the antenna element 10 as is indicated in FIG. 8. By turning or twisting the supporting member 20 around its eccentrically positioned pin 21 a varying portion of the supporting element will be underneath the antenna element 10 and thus an adjustment of the resonance, will be achieved as is illustrated in FIG. 9. Thereby the VSWR curve minimum of the antenna element can be adjusted along the frequency axis of the graph to the right in FIG. 9.

Figure 10:
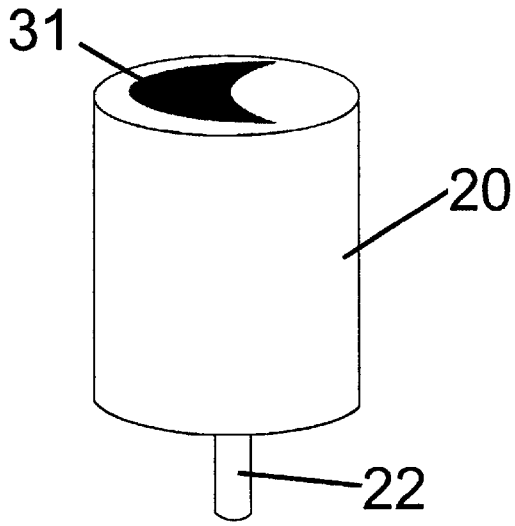
FIG. 10 illustrates a second embodiment of a supporting member with a centered pin and a profiled metal surface on top.

In FIG. 10 is demonstrated a second embodiment of the supporting member. Here the supporting member 20 has a central pin 22 and is provided with a particularly designed form of its metal surface 31 at the top. Similar to FIG. 8 the antenna element makes contact with the metal surface 31. By turning the supporting member 20 around its central pin, the resonance frequency of the antenna element 10 can be simply tuned. In the embodiment according to FIG. 6 the supporting element 20 is for instance positioned at the edge of the end of the strip line element forming the antenna radiator member 10. However, as will be realized by a person skilled in the art, the supporting element 20 may also be positioned at an edge along the strip-line element, for instance at a mid-point of the antenna element 10.

It will also be obvious to a person skilled in the art that the member 20 could have a height such that it does not make contact with the antenna element but instead utilizing the small capacitive coupling to the antenna element for the tuning of the VSWR curve.

Figure 11:
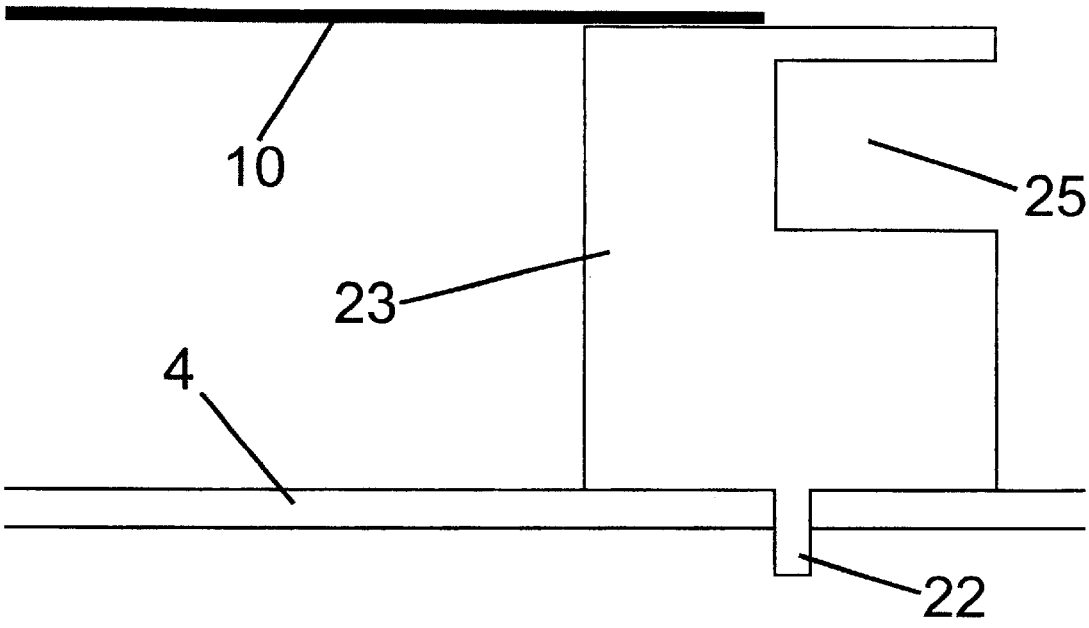
FIG. 11 illustrated a third embodiment of a supporting member including a centered pin and a slotted plastic piece.

A third embodiment of the supporting member is demonstrated in FIG. 11. The supporting member 23 of FIG. 11 includes a centered pin 22 and forms a slotted unsymmetrical plastic piece. By turning the supporting member 23 around the centered pin 22 the antenna element can be tuned as the amount of plastic forming a dielectric material, which will vary the capacitance introduced by the supporting member as a function of the turning angle of its slot 25.

Figure 12:
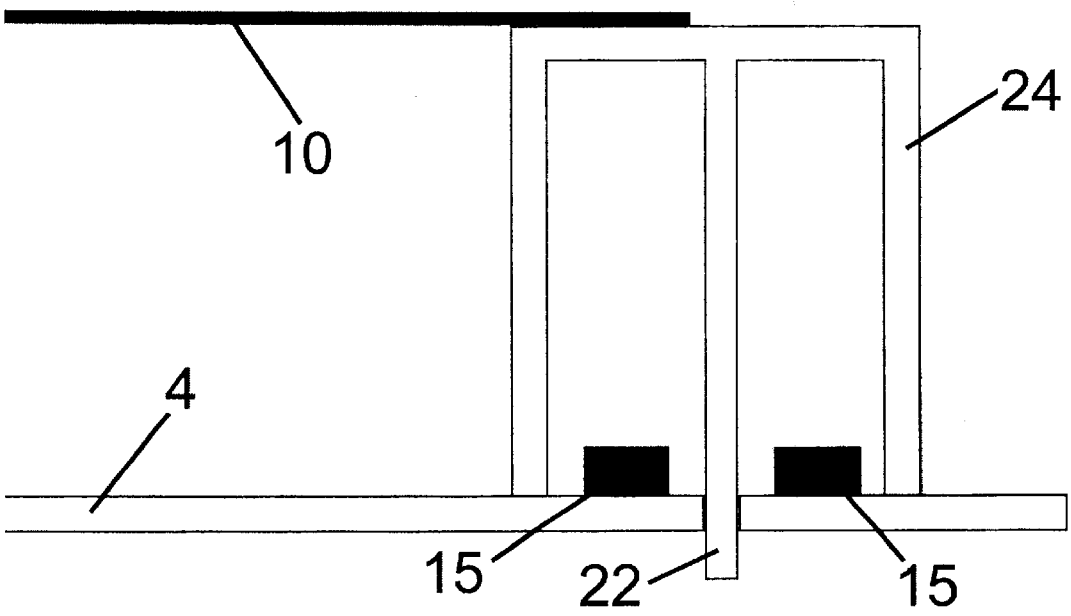
FIG. 12 illustrates a further embodiment of the supporting member with a centered pin and a hollow interior for giving space to one or more components on the PCB.

FIG. 12 illustrates an embodiment presenting of a hollow supporting member 24 with a central pin, which then permits even more surface for components on the PCB 4 as indicated by the components 15 underneath the turnable supporting member. This is for instance applicable to the embodiments of the support member according to FIG. 10, FIG. 11 and FIG. 13.

Figure 13:
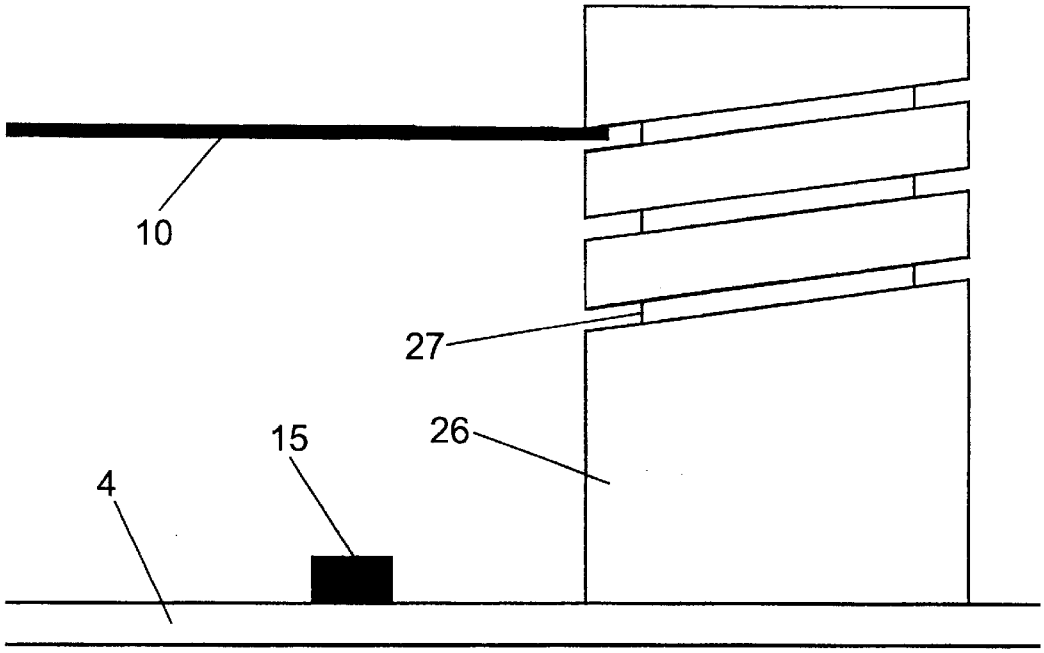
FIG. 13 illustrates an embodiment of a non-conducting supporting device comprising a thread for tuning of the integrated antenna.

Finally FIG. 13 illustrates a third type of supporting member 26 with a central pin for rotation of the support. The supporting member 26 is provided with a thread, which will receive an edge of the antenna element 10. By turning the support the distance between the antenna element 10 and the PCB 4 will be slightly varied and set, and thereby the frequency response of the small antenna element 10 will be adjusted. Besides, the thread will lock the distance between the antenna element 10 and the PCB 4 and thereby even further improve reliability of the RF module. Also this type of supporting member may as mentioned utilize the hollow design of the support element disclosed in FIG. 12.

Figure 14:
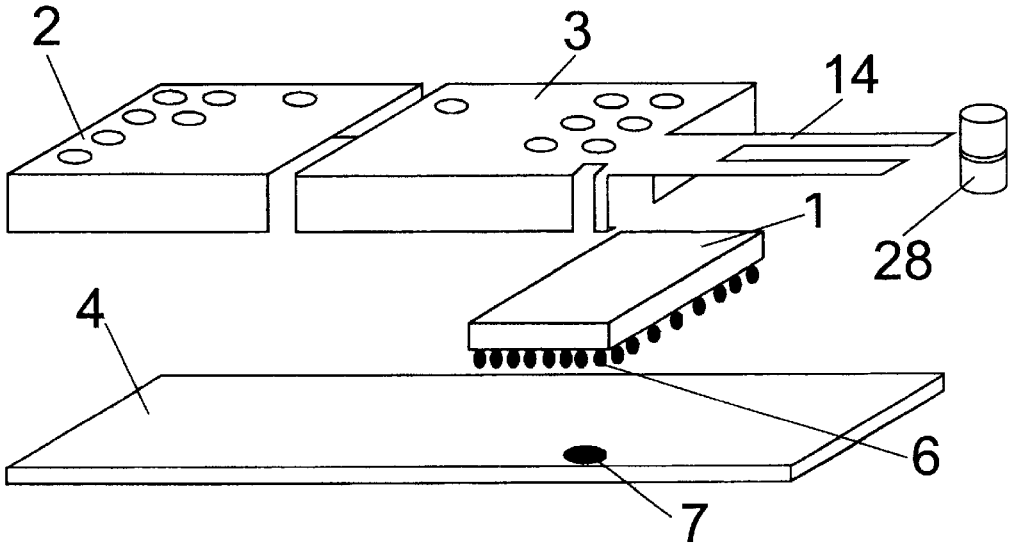
FIG. 14 illustrates still another embodiment of the RF module of FIG. 2 presenting a planar antenna device to be tuned by means of a sliding member.

Finally FIG. 14 illustrates still another embodiment of the RF module of FIG. 2. The RF module of FIG. 14 utilizes a planar antenna device, which is to be tuned by means of a sliding member 28. In the illustrative embodiment of FIG. 14 the sliding tuning member provided with a suitable slot is inserted between the two legs of the antenna element 14 for a tuning of the antenna VSWR. The disclosed generally non-conducting member 28 is illustrated a round piece of material, but it will be obvious to a person skilled in the art that the member may have an arbitrary form for obtaining the tuning function. The member 28 may either be resting against a suitable component mounted on the printed circuit board 4 or main PCB 5 and shifted or slid along a supporting element (not shown) placed over the components of the printed circuit board not to occupy PCB component space of the device.

It will be understood by those skilled in the art that various modifications and changes may be made to the present invention without departure from the scope thereof, which is defined by the appended claims.

What is claimed is:

1. An antenna device in a radio frequency module, wherein an antenna radiator member of the antenna device comprises an integrated portion of a metallic shield screening at least a part of the components of the radio frequency module on a printed circuit board, and the metallic shield is produced from a single metallic sheet or a molded metallized piece being formed to a desired shape to thereby form the antenna radiator member integrated with the screening portion of the metallic shield, the antenna radiator member extending over or resting against a supporting element, whereby a voltage standing wave ratio of the antenna radiator member is tunable by manipulating the supporting element, which rests on a printed circuit board underlying the antenna device, the supporting element having a position that is one of along a middle portion and at an end portion of the antenna radiator member and comprising a non-conducting stud with an asymmetric pin inserted into a printed circuit board for tuning the antenna radiator member by twisting the non-conducting supporting element.

2. The antenna device according to claim 1, wherein said non-conducting stud is provided with a metallized top surface abutting said antenna radiator member.

3. An antenna device in a radio frequency module, wherein an antenna radiator member of the antenna device comprises an integrated portion of a metallic shield screening at least a part of the components of the radio frequency module on a printed circuit board, and the metallic shield is produced from a single metallic sheet or a molded metallized piece being formed to a desired shape to thereby form the antenna radiator member integrated with the screening portion of the metallic shield, the antenna radiator member extending over or resting against a supporting element, whereby a voltage standing wave ratio of the antenna radiator member is tunable by manipulating the supporting element, which rests on a printed circuit board underlying the antenna device, the supporting element having a position that is one of along a middle portion and at an end portion of the antenna radiator member and comprising a non-conducting stud with a central pin inserted into a printed circuit board for turning the supporting element around the central pin when tuning the antenna radiator member.

4. The antenna device according to claim 3, wherein said non-conducting stud is provided with a shaped metallized top surface abutting the antenna radiator member for tuning the antenna radiator member by rotating said non-conducting supporting element around said central pin.

5. The antenna device according to claim 4, wherein said supporting element is partly hollow to leave space for further components underneath said supporting element.

6. An antenna device in a radio frequency module, wherein an antenna radiator member of the antenna device comprises an integrated portion of a metallic shield screening at least a part of the components of the radio frequency module on a printed circuit board, and the metallic shield is produced from a single metallic sheet or a molded metallized piece being formed to a desired shape to thereby form the antenna radiator member integrated with the screening portion of the metallic shield, the antenna radiator member extending over or resting against a supporting element, whereby a voltage standing wave ratio of the antenna radiator member is tunable by manipulating the supporting element, which rests on a printed circuit board underlying the antenna device, the supporting element having a position that is one of along a middle portion and at an end portion of the antenna radiator member and comprising a non-conducting slotted stud with a central pin inserted into a printed circuit board for turning the supporting element around the central pin when tuning the antenna radiator member.

7. The antenna device according to claim 6, wherein said supporting element is partly hollow to leave space for further components underneath said supporting element.

8. An antenna device in a radio frequency module, wherein an antenna radiator member of the antenna device comprises an integrated portion of a metallic shield screening at least a part of the components of the radio frequency module on a printed circuit board, and the metallic shield is produced from a single metallic sheet or a molded metallized piece being formed to a desired shape to thereby form the antenna radiator member integrated with the screening portion of the metallic shield, the antenna radiator member extending over or resting against a supporting element, whereby a voltage standing wave ratio of the antenna radiator member is tunable by manipulating the supporting element, which rests on a printed circuit board underlying the antenna device, the supporting element having a position that is one of along a middle portion and at an end portion of the antenna radiator member and comprising a non-conducting stud with a central pin inserted into the printed circuit board, the non-conducting stud being provided with a thread in engagement with the antenna radiator member and used for adjusting and locking a distance between a printed circuit board and the antenna radiator member, thereby enabling tuning the antenna radiator member by turning the supporting element around the central pin.

9. The antenna device according to claim 8, wherein said supporting element is partly hollow to leave space for further components underneath said supporting element.

* * * * *